US005763370A

United States Patent [19]

Doner et al.

[11] Patent Number: 5,763,370

[45] Date of Patent: Jun. 9, 1998

[54] FRICTION-REDUCING AND ANTIWEAR/EP ADDITIVES FOR LUBRICANTS

[75] Inventors: John Phillips Doner, Sewell; Liehpao Oscar Farng, Cherry Hill, both of N.J.

[73] Assignee: Mobil Oil Corporation, Fairfax, Va.

[21] Appl. No.: 770,216

[22] Filed: Dec. 19, 1996

Related U.S. Application Data

[63] Continuation-in-part of Ser. No. 502,725, Jul. 14, 1995, abandoned, which is a continuation-in-part of Ser. No. 181,135, Jan. 13, 1994, abandoned.

[51] Int. Cl.[6] ..... C10M 135/18; C10M 137/10

[52] U.S. Cl. ..... 508/364; 508/369; 556/31; 556/39

[58] Field of Search ..... 508/363, 365, 508/369, 371, 364; 556/31, 39

[56] References Cited

U.S. PATENT DOCUMENTS

| | | | |
|---|---|---|---|
| 4,648,985 | 3/1987 | Thorsell et al. | 508/364 |
| 4,786,423 | 11/1988 | Schroeder | 508/365 |

*Primary Examiner*—Jacqueline V. Howard
*Assistant Examiner*—Cephia D. Toomer
*Attorney, Agent, or Firm*—Penny L. Prater; Malcolm D. Keen

[57] ABSTRACT

Pre-blended combinations and reaction products of at least one metallic dithiocarbamate and at least one metallic dithiophosphate provide the synergism of antiwear properties with friction-reducing properties for lubricants and greases.

7 Claims, No Drawings

FRICTION-REDUCING AND ANTIWEAR/EP ADDITIVES FOR LUBRICANTS

CROSS REFERENCE TO RELATED APPLICATIONS

The instant application is a continuation-in-part of U.S. Ser. No. 08/502,725, filed on Jul. 19, 1995, which is a continuation-in-part of U.S. Ser. No. 08/181,135, filed on Jan 13, 1994, both applications are abandoned.

FIELD OF THE INVENTION

This invention is directed to combinations and reaction products of metallic dithiocarbamates and metallic dithiophosphates, and their use as additives in lubricants because of their synergistic properties. More particularly, it is directed to compositions of lubricants and greases containing such additives.

BACKGROUND OF THE INVENTION

Mechanical systems under heavy loads will deteriorate due to the frictional forces created by relatively moving, rubbing and bearing metal surfaces. Often, lubricants for such operations cannot prevent wear of the metal nor reduce the coefficient of friction and as a result the system performance is affected.

Antiwear additives and friction modifying additives are frequently blended with lubricants in order to prevent wear, reduce fuel consumption and increase the operating life of the machinery. The term "anti-load" is in some instances used instead of "antiwear", but the term "antiwear" is used throughout this disclosure.

In order to minimize wear, various additives have been added in the past to lubricants to produce a protective surface film on the metal parts. However, the antiwear lubricants may exhibit other unsatisfactory lubricating characteristics such as corrosive wear due to chemical reaction between the additive and the metal surfaces, and deterioration due to oxidation under high temperature conditions. Supplemental lubricating additives may subsequently be necessary in order to prevent such detrimental effects.

In order to minimize friction, various friction-reducing additives have been added to lubricants to produce a smooth surface film. However, the friction additives may dominate the metal surface and prevent the anti-wear additives from encoun- tering the surface to form an effective film. Friction and wear are two different phenomena. Often, it is difficult to prevent wear and reduce friction simultaneously, even in the presence of both antiwear additives and friction-modifying additives. The instant invention provides unexpected results by providing both low friction and low wear properties in a single additive formulation. Synergism can be obtained by the use of pre-blended combinations of specific antiwear and friction-modifying agents or reaction products of such agents. Synergistic behavior cannot be achieved through the simple component blending process (i.e., lubricant and grease formulation blending). This invention is very significant to applications involving machinery, bearings and joint lubrication.

Lubricants, such as lubricating oils and greases, are subject to oxidative deterioration at elevated temperatures or upon prolonged exposure to the elements or exhaustion of useful life. Such deterioration is evidenced, in many instances, by an increase in both acidity and viscosity, and when the deterioration is severe enough, it can cause metal parts to corrode. Additionally, severe oxidation leads to a loss of lubrication properties, and in especially severe cases this may cause complete breakdown of the device being lubricated.

The metal salts of diorganodithiocarbamic acids have been described as multifunctional, antioxidant, antiwear and corrosion inhibiting additives for lubricants. They are also noted for their metal deactivating properties.

Metallic dithiophosphates are well-known for their use as effective corrosion/oxidation inhibitors as well as anti-wear additives in many lubricant and grease applications, including engine oils and industrial oils.

The beneficial effects of the of the instant invention are believed to be the result of an internal synergism between suitable metal groups, dithiophosphate groups, and dithiocarbamate groups within the same lubricant compositions. The pre-blended combinations and reaction products of this invention show good stability and compatibility when used in the presence of other commonly used additives in grease or lubricant compositions.

DESCRIPTION OF THE PRIOR ART

The use of metallic dithiocarbamates as additives in rubber and polymer applications is well known in the prior art. U.S. Pat. No. 4,278,587 (Wolff et al.) discloses zinc dialkyl dithiocarbamates as effective accelerators and antioxidants. U.S. Pat. No. 4,919,830 (Farng et al.) disclosed the use of organic phosphates derived from dithiocarbamates as lubricant additives, having notable antioxidant and anti-wear properties.

U.S. Pat. No. 5,002,674 (Farng et al.) discloses that ashless thiophosphates (such as 4,4-methylene bis(dibutyl dithiocarbamate) derived from dihydrocarbyl dithiocarbamates are effective multifunctional additives for lubricants, having antioxidant and antiwear properties.

U.S. Pat. No. 4,290,202 (Levine et al.) discloses molybdenum dialkyl dithiophosphates which have utility as extreme pressure and antiwear agents. Metallic dithiophosphates (such as zinc or molybdenum dialkyl dithiophosphates) are well known for their use as effective corrosion/oxidation inhibitors as well as antiwear additives in many lubricant and grease applications including engine oils and industrial oils.

U.S. Pat. No. 4,360,438 (Rowan et al.) discloses synergistic antiwear compositions comprising a sulfurized molybdenum dialkyldithiocarbamate and an organic sulfur compound selected from the group consisting of dithiocarbamate acid esters, sulfurized oils and polysulfurized olefins. Dithio-carbamates are further discussed in an article coauthored by one of the inventors of '438, H. H. Farmer. The chemistry of dithiocarbamates and their mechanisms are discussed in "Dithio-carbamate Additives in Lubricating Greases", A. F. Polishuk and H. H. Farmer, *NLGI Spokesman*, September, 1979, pp. 200–205.

U.S. Pat. No. 2,492,314 (Olin et al.) discloses a process for the production of metal salts of substituted dithiocarbamic acids. The preparation of a zinc salt of an alkyl dithiocarbamic acid is one salt disclosed.

SUMMARY OF THE INVENTION

The instant invention is directed to products of reaction and pre-blended combinations of metallic dithiocarbamates and metallic dithiophosphates, having synergistic anti-wear and friction reducing capacities. Although the reaction products may vary according to the conditions employed, they are effective if their structures contain (a) metal dithiophosphates and (b) metal dithiocarbamates. The metals maybe selected from the groups consisting of nickel, antimony, molybdenum, copper, cobalt, iron, cadmium, zinc, manganese, sodium, magnesium, calcium and lead.

These products and combinations may be used as additives to lubricants and greases, providing enhanced friction-reducing, and antiwear properties at extreme pressures. They can significantly extend the service life of engines. Additional antioxidation, cleanliness, antifatigue, high temperature stabilizing, and anticorrosion properties are also potentially present. The products of this invention show good stability and compatibility when used in the presence of other commonly used additives in grease or lubricant compositions. They are useful at low concentrations in lubricants.

DESCRIPTION OF THE PREFERRED EMBODIMENTS

This invention is directed to additives suitable for use in lubricant oils which are prepared in a process comprising reacting in an appropriate reaction zone (or mixing in preblended combinations) a metallic dithiocarbamate and a metallic dithiophosphate. The preferred dithiocarbamates are zinc, nickel and antimony dialkyl dithiocarbamates. The most preferred dithiocarbamate is antimony dialkyl dithiocarbamate. The alkyl groups are preferably 2–30 carbons in length, preferably between 8 and 15 carbon atoms. Antimony dialkyl dithiocarbamate is illustrated below:

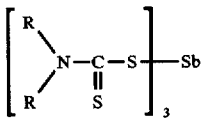

The dithiocarbamates are dark amber liquids, with a viscosity at 100° C. of about 50 SUS (7.25 cS). The flash point (open cup) is about 171° C. (340° F.). The pour point is about −23°C. (−10°F.).

Metallic dithiocarbamates, such as antimony dialkyl dithiocarbamates, may be obtained commercially from the R. T. Vanderbilt Chemical Company (under the trade name VanLube 73)as well as from other sources. Metallic dithiocarbamates may also be synthesized. Sodium dialkyl dithiocarbamates can be synthesized by reacting equal molar amounts of sodium hydroxide, a secondary dialkyl amine, and carbon disulfide in aqueous media or organic solution depending on conditions as illustrated below:

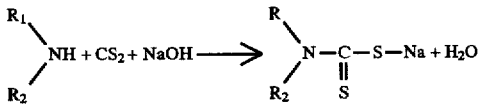

Sodium dialkyl dithiocarbamates can also be used to prepare other metal dialkyl dithiocarbamates, such as those containing antimony or zinc. Preparation of an antimony dialkyl dithiocarbamate is illustrated below:

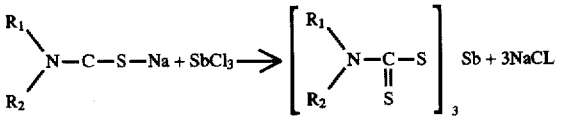

Zinc dialkyl dithiocarbamates may be made by reacting sodium dialkyl carbamates with $ZnSo_4$, $ZNCl_2$ or $Zn(OH)_2$.

The general blending or reaction conditions when the metallic dithiocarbamate and the metallic dithiophosphate phosphate are combined and may be any suitable conditions known in the art. Temperatures will usually vary from about −20° C. to about 250° C. The temperature is preferably between 50° C. and 150° C. Reaction rather than blending will usually occur if the temperature is between 70° C. and 100° C. If a solvent is used the reaction conditions may vary. Usually atmospheric or ambient pressure is used, however, higher or lower pressures may be used if desired. The time required for reaction will vary primarily with the temperature, pressure and solvent used, if any. If a solvent is used it may be polar or non-polar. Polar solvents include acetones, alcohols, ethers and esters. Non-polar solvents include both aliphatic and aromatic hydrocarbons.

Metallic dithiophosphates useful in the instant invention include molybdenum, zinc, copper, lead, magnesium and cadmium dithiophosphates. Molybdenum dialkyl phosphorothioate is commercially available from several sources. It is sold by R. T. Vanderbilt Chemical Company under the trade name Molyvan L. The most preferred compounds useful in the instant invention are sulfurized oxymolybdenum organophosphorodithioates, illustrated below:

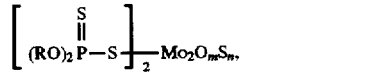

where R represents alkyl or alkylaryl, m=2 to 3, n=2 to 1, and m+n=4.

They have previously been disclosed in U.S. Pat. Nos. 3,400,140 and 3,494,866 as well as in U.S. Pat. No. 4,290,902. R may be an alkyl, cycloalkyl, aryl, or alkaryl radical. In most cases it is an alkyl chain of 2 to 30 carbons. These dithiophosphates (also known as phosphoro-dithioates) are dark green liquids, with a viscosity at 100° C. of about 56 SUS (90 cST). The flash point (open cup) is about 166° C. (330° F.). The pour point is about −37° C. (−35° F.).

In the preparation of molybdenum dialkyl phosphorothioates it is important to use 2 mole of phosphorodithioic acid reactant for each mole of molybdate reactant to obtain a maximum yield, with one phosphorodithioate radical per molybdenum atom. No catalyst is required for the reaction. Water is a suitable solvent but other inert solvents may be present, such as a low viscosity aromatic base oil.

The reaction product may be solid or liquid depending on the organic radical in the phosphorodithioic acid reactant. If the molybdenum-containing product is a solid, it is recovered by filtration. If the molybdenum-containing product is a liquid, it is recovered by filtering out any solid by-products and by distilling to remove the solvent.

The dithiophosphates may be prepared by dissolving molybdic oxide in a solution of alkali metal hydroxide, magnesium hydroxide, beryllium hydroxide or ammonium hydroxide and by incorporating subsequently an approximately equivalent amount, based on hydroxide, of a strong mineral acid, such as sulfuric acid. An organophosphorodithioic acid reactant may be alternately prepared by treating a monohydric alcohol or phenol with phosphorus pentasulfide in the mole ratio of 4:1. The phosphorodithioic acid reactant is then added to the molybdate solution with subsequent finishing operations to form a sulfurized oxymolybdenum organophosphorodithioate.

It is important herein to heat the mixture of phosphorodithioic acid and molybdate solution at the reflux temperature, e.g., from about 85° C. to 100° C. The reaction time is generally 1 to 5 hours.

The generalized reaction of the instant invention is as follows (provided a reaction product rather than a blended mixture is made):

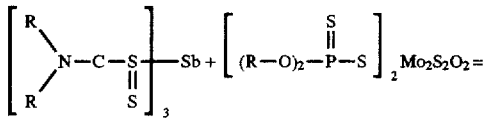

Structure containing suitable metallic groups, i.e. Mo and Sb, dithiophosphate groups and dithiocarbamate groups which act in synergism to provide antiwear-carrying and friction-reducing properties. The structures of the actual reaction products are not precisely known.

In the preparation of the blended combinations and reaction products, an excess of one component or another can be used. Molar quantities, less than molar quantities, or more than molar quantities of either metallic dithiocarbamates or metallic dithiophosphates can be used. The metallic dithiocarbamates and the metallic dithiophosphates may be combined in any ratio from about 1:9 to about 9:1.

The base lubricants which are useful with the additives of this invention may be any oil of lubricating viscosity, whether natural or synthetic. The natural oils include paraffinic, naphthenic oils, or mixtures of them, neutral distillates and bright stocks. Among the synthetic oils are polyolefin (synthetic hydrocarbon) fluids, such as the polyolefins and hydrogenated polyolefins, especially the poly (alpha) olefins and hydrogenated poly (alpha) olefins. These are derived from olefins with about 5 to 20 carbon atoms, particularly from 8 to 14 carbon atoms such as the poly 1-decenes and hydrogenated poly 1-decenes, as well as polybutenes including polyisobutenes.

Esters of dibasic acids may also be used as synthetic oils. These include the esters of $C_6$–$C_9$ dibasic acids such as sebacic, azelaic and adipic acids having branched chain alcohols, such as 2-ethylhexanol or the $C_8$–$C_{10}$ oxoalcohols. Useful esters include di(2-ethylhexyl)sebacate, di(2-ethylhexyl)adipate, and dibutylphthalate.

Esters of polyols such as the neopentyl polyols including neopentyl glycol, trimethylol propane, triethylol propane and pentaerythritol may also be used as synthetic hydrocarbon oils.

The esters of such polyols with monobasic carboxylic acids such as the $C_5$–$C_9$ acids or mixtures of acids are examples.

Polyglycols such as polypropylene glycol, polyethylene glycol, and mixed polyoxyalkylene glycols can also be used as synthetic oils.

The base lubricant contemplated may also be a grease formulated by adding a grease-forming quantity of a thickening agent to one of the oils mentioned above. For this purpose a wide variety of materials may be employed. These thickening agents or gelling agents may include any of the conventional metal salts or soaps which are dispersed in the lubricating oil in grease-forming quantities in such degree as to impart to the resulting grease the desired consistency. Other thickening agents that may be employed in the formulation may comprise non-soap thickeners, such as modified clays and silicas and aryl ureas.

To achieve the purposes of this invention the lubricant compositions should contain from about 0.01 to about 8 wt. % and more preferably from about 1.5 to 6 wt. % of the previously described synergistic preparation. Any other lubricant additives may be also incorporated, up to about 15 wt. % into the lubricant compositions for their known purposes.

Having described the invention broadly, the following are offered as specific illustrations. They are illustrative only and are not intended to limit the invention.

EXAMPLE 1

A Preblended Combination of Molybdenum Dithiophosphate and Antimony Dithiocarbamate Approximately 17 gm of molybdenum di-2-ethylhexyl dithiophosphate (commercially obtained from R.T. Vanderbilt Chemical Company under the trade name Molyvan L) and 3 gm of antimony diamyl dithiocarbamate (commercially obtained from R. T. Vanderbilt Chemical Company under the trade name VanLube 73) were blended together in a mixer at room temperature for one hour. Thereafter, approximately 20 gm of yellow-green liquid was recovered as desired blending product.

EXAMPLE 2

A Preblended Combination of Molybdenum Dithiophosphate and Antimony Dithiocarbamate Approximately 14 gm of molybdenum di-2-ethylhexyl dithiophosphate and 6 gm of antimony diamyl dithiocarbamate were blended together in a mixer at room temperature for an hour. Thereafter, approximately 20 gm of yellow-green liquid was recovered as desired blending product.

EXAMPLE 3

A Preblended Combination of Molybdenum Dithiophosphate and Antimony Dithiocarbamate Approximately 10 gm of molybdenum di-2-ethylhexyl dithiophosphate and 10 gm of antimony diamyl dithiocarbamate were blended together in a mixer at room temperature for an hour. Thereafter, approximately 20 gm of yellow-green liquid was recovered as desired blending product.

EXAMPLE 4

A Reaction Product of Molybdenum Dithiophosphate and Antimony Dithiocarbamate Approximately 17 gm of molybdenum di-2-ethylhexyl dithiophosphate (commercially obtained from R. T. Vanderbilt Chemical Company under the trade name Molyvan L) and 3 gm of antimony diamyl dithiocarbamate (commercially obtained from R. T. Vanderbilt Chemical Company under the trade name VanLube 73) were blended together in a mixer at 80° C. for an hour. Thereafter, approximately 20 gm of yellow-green liquid was recovered as desired blending product.

EXAMPLE 5

A Reaction Product of Molybdenum Dithiophosphate and Antimony Dithiocarbamate Approximately 14 gm of molybdenum di-2-ethylhexyl dithiophosphate and 6 gm of antimony diamyl dithiocarbamate were blended together in a mixer at 80° C. for one hour. Thereafter, approximately 20 gm of yellow-green liquid was recovered as desired product.

EXAMPLE 6

A Reaction Product of Molybdenum Dithiophosphate and Antimony Dithiocarbamate Approximately 10 gm of molybdenum di-2-ethylhexyl dithiophosphate and 10 gm of antimony diamyl dithiocarbamate were blended together in a mixer at 80° C. for one hour. Thereafter, approximately 19.5 gm of yellow-green mixture was recovered as desired product.

EXAMPLE 7

A Reaction Product of Molybdenum Dithiophosphate and Antimony Dithiocarbamate Approximately 85 gm of molybdenum di-2-ethylhexyl dithiophosphate and 15 gm of antimony diamyl dithiocarbamate were blended together in a mixer at 80° C. for one hour, then at 100° C. for another hour. Thereafter, a mixture of green liquid and yellow solid was recovered as desired product.

EXAMPLE 8

A Reaction Product of Molybdenum Dithiophosphate and Antimony Dithiocarbamate Approximately 50 gm of molybdenum di-2-ethylhexyl dithiophosphate and 50 gm of antimony diamyl dithiocarbamate were blended together in a mixer at 80° C. for one hour, then at 100° C. for another hour. Thereafter, a mixture of green liquid and yellow solid was recovered as desired product.

Wear Reducing Properties

The products of the Examples were blended into a non-additized lithium grease and evaluated for antiwear performance using the 4-Ball Wear Test at 1200 rpm, 40 kg load, 60 minutes, at 75° C. (167° F.) (See Table 1). Reported is the wear scar diameter in millimeters and cF, the coefficient of friction. The products of the examples were blended into the base grease at the concentration indicated in Table 1.

In the 4-Ball Wear Test, three stationary balls are placed in the reference lubricant or base grease, in this case a paraffinic-naphthenic mineral oil plus a lithium thickener made from a blend of 12-hydroxy and tallow fatty acids. The compound to be tested is added thereto, and a fourth ball is placed is placed in a chuck mounted on a device which can be used to spin the ball at known speeds and loads. The samples were tested using 0.5 inch stainless steel balls of 52100 steel for a known period of time, typically 30 to 60 minutes. The diameters of the wear scars are measured after completion of the test.

The significance of pre-blending the components prior to adding them to the base grease is illustrated by Examples 9 and 10.

EXAMPLE 9

Individual components of Molybdenum Dithiophosphate and Antimony Dithiocarbamate were blended into base grease without preblending.

Three (3) grams of molybdenum di-2-ethylhexyl dithiophos- phate (commercially obtained from the R. T. Vanderbilt Company under the trade name Molyvan L) were blended into 94 grams of non-additized lithium base grease immediately followed by 3 grams of antimony diamyl dithiocarbamate (commercially obtained from the R. T. Vanderbilt Company under the trade name VanLube 73). The grease and components were mixed at 25° C. for one hour.

EXAMPLE 10

Individual components of Molybdenum Dithiophosphate and Antimony Dithiocarbamate were blended into base grease without preblending.

Two point fifty five (2.55) grams of molybdenum di-2-ethylhexyl dithiophosphate were blended into 94 grams of non-additized lithium base grease immediately followed by 0.45 grams of antimony diamyl dithiocarbamate. The grease and components were mixed at 25° C. for one hour.

The criticality of pre-blending is illustrated from Examples 9 and 10 in which the components were added to the base grease with no pre-blending. The low friction results for these two blends compared with the friction results for Examples 1 or 3 is evidence for the importance of the pre-blending. While a pre-blending at 80° C. is preferred, even pre-blending at 25° C. yields improvements not obtained from the blends which did not undergo any pre-blending, i.e., Examples 9 and 10.

The criticality of pre-blending is illustrated by the following dissimilar results:

When the components are blended into the grease at room temperature for one hour as in Examples 9 and 10, ASTM D-2266 coefficient of friction is high as compared to that of Examples 1, 2 and 3 (see Table 1). In Example 10 when the components are mixed (pre-blended) at room temperature for one hour and then mixed into the grease (Examples 1, 2 and 3) the ASTM Method D-2266 friction result is lower than that of Examples 1, 2 and 3.

TABLE 1

4 Ball Test (ASTM Method D-2266) Has Been Used To Measure: Wear and Coefficient of Friction*

| | 4 Ball Wear Data, Scar Diameter, mm | 4 Ball Friction Data, Coefficient of Friction |
|---|---|---|
| Base Grease (paraffinic-naphthenic mineral oils plus a lithium thickener made from a blend of 12-hydroxy and tallow fatty acids) | 0.525 | 0.096 |
| 3% Example 3 in Base Grease | 0.430 | 0.065 |
| 3% Example 8 in Base Grease | 0.458 | 0.044 |
| 1.5% Example 3 in Base Grease | 0.469 | 0.075 |
| 1.5% Example 8 in Base Grease | 0.400 | 0.063 |
| 6% Example 1 in Base Grease | 0.404 | 0.071 |
| 6% Example 4 in Base Grease | 0.375 | 0.067 |

*(40 Kg, 1200 rpm, 75° C., 60 minutes)

The results above demonstrate that the additives of the examples exhibit friction reducing activities and considerable antiwear activity. The most effective grease and additive compositions are 6% Example 4 and 3% Example 8, since they have the smallest wear scar diameters and coefficients of friction, respectively, in comparison with the base grease.

Cameron Plint Wear Test

The Cameron-Plint Wear Test measures frictional force employing a reciprocating friction machine. The machine employs a line contact as opposed to a point contact (a point contact uses a ball on a flat surface). The line contact specimen configuration operates at 50 Hz, 100N load, and a 0.76 mm stroke. The temperatures are ramped from 50° C.

to 165° C. The duration of the test was 30 minutes. Sample specimens consisted of a hardened steel (62 Rockwell C) ground gauge plate, finished to a surface roughness of 0.45 microns, and a 16 mm long nitride steel dowel pin as the contact (6 mm diameter, 60 Rc). Metallurgy for the plate and line contact are defined in British Standards BS 4659 and BS 1804 respectively. The steel specimens were immersed in approximately 10 ml of lubricant. Friction coefficients were calculated from frictional force by dividing by the load value, typically 100 N, and were generally repeatable to +/−0.005.

TABLE 2

Cameron Plint Wear Test
(100N, 0.76 mm stroke, 50 Hz, 50° C., and 30 Min.)

| Item | Wear Scar Diameter (mm) | Coefficient of Friction |
|---|---|---|
| Base grease (paraffinic-naphthenic mineral oils plus a lithium thickener made from a blend of 12-hydroxy and tallow fatty acids) | 0.270 | 0.079 |
| Plus 4% Example 4 | 0.308 | 0.043 |
| Plus 4% Example 5 | 0.330 | 0.041 |
| Plus 4% Example 6 | 0.325 | 0.048 |

In Table 2, the grease compositions containing the additives of the examples show a decrease in the friction coefficient from that of the base grease.

Optimal SRV Friction and Wear Test

The Optimal SRV Friction and Wear Test evaluates the friction, wear and breakaway torque characteristics of lubricants and materials under high-speed oscillation. A mobile specimen oscillates on a fixed specimen to simulate rolling and sliding friction. Point, line and area contact geometries can be simulated. The load, in this case 100 N, is maintained at 50° C. for 30 minutes. The oscillation frequency is 50 Hz. The stroke, for measuring sliding friction, is 1 mm. In the test, a 10 mm steel ball is oscillated under a specific load on a lapped steel disk lubricated with the grease or lubricant being tested until seizure occurs. At the conclusion of the time interval the bottom disk is cleaned with heptane and the wear scar is measured using a profilometer. Both scar depth and width measurements are recorded as an indication of the wear that occurred during the test. From these, the coefficient of friction can be calculated.

TABLE 3

Optimal SRV Friction & Wear Test
(100N, 1 mm stroke, 50 Hz, 50° C. and 30 min.)

| Item | Coefficient of Friction |
|---|---|
| Base grease (paraffinic-naphthenic mineral oils plus a lithium thickener made from a blend of 12-hydroxy and tallow fatty acids) | 0.120 |
| Plus 6% Example 3 | 0.095 |

TABLE 3-continued

Optimal SRV Friction & Wear Test
(100N, 1 mm stroke, 50 Hz, 50° C. and 30 min.)

| Item | Coefficient of Friction |
|---|---|
| Plus 6% Example 6 | 0.088 |
| Plus 3% Example 3 | 0.070 |
| Plus 3% Example 6 | 0.074 |
| Plus 1.5% Example 3 | 0.085 |
| Plus 1.5% Example 6 | 0.060 |
| Plus 6% Example 1 | 0.070 |
| Plus 6% Example 4 | 0.072 |
| Plus 6% Example 7 | 0.068 |
| Plus 1.5% Example 1 | 0.095 |
| Plus 1.5% Example 4 | 0.052 |

The product of each example demonstrated a lower coefficient of friction than that of the base grease. There was a tendency, however, for the coefficient of friction to be lower in the examples where blending had occurred at an elevated temperature (apparently in which a reaction had occurred) than in the examples where the components had merely been mixed.

What is claimed is:

1. A product of reaction, which demonstrates enhanced antiwear properties combined with effective friction reducing properties in a synergistic effect when added to lubricants and greases, made by reacting for a period of at least one hour in a ratio of from about 1:9 to 9:1, at a temperature between 70° C. and 100° C., antimony diamyl dithiocarbamate and molybdenum di-2-ethylhexyl dithiophosphate.

2. A lubricant composition comprising a lubricating oil or a grease prepared therefrom, and an effective friction-reducing properties in a synergistic effect of a reaction product made by reacting for a period of at least one hour in a ratio of from about 1:9 to 9:1 at a temperature between 70° C. and 100° C., antimony diamyl dithiocarbamate and molybdenum di-2-ethylhexyl dithiophosphate.

3. The lubricant composition of claim 2, wherein the reactants are combined to form the reaction product prior to addition to the lubricating oil.

4. The composition of claim 2, wherein the lubricating oil is a natural oil of lubricating viscosity, a synthetic oil of lubricating viscosity, or a mixture of both synthetic and natural oils.

5. The composition of claim 4, wherein the natural oil is selected from the group consisting of paraffinic oils, naphthenic oils, neutral distillates and bright stocks.

6. The composition of claim 4, wherein the synthetic oil is selected from the group consisting of polyolefins, polyglycols, esters of dibasic acids, and esters of polyols.

7. A process for the production of a lubricant additive possessing the synergism of antiwear and antifrictional properties, wherein antimony diamyl dithiocarbamate and molybdenum di-2-ethylhexyl dithiophosphate are reacted at atmospheric pressure in a temperature range between 70° C. to 100° C.

* * * * *